US007056238B1

(12) United States Patent
Brown

(10) Patent No.: US 7,056,238 B1
(45) Date of Patent: Jun. 6, 2006

(54) HAND-HELD OFFENSIVE LINEMAN TRAINING PAD

(76) Inventor: John L. Brown, 13333 Rene Cir., Santa Fe, TX (US) 77510

( * ) Notice: Subject to any disclaimer, the term of this patent is extended or adjusted under 35 U.S.C. 154(b) by 0 days.

(21) Appl. No.: 10/793,499

(22) Filed: Mar. 4, 2004

Related U.S. Application Data

(60) Provisional application No. 60/451,740, filed on Mar. 4, 2003.

(51) Int. Cl.
*A63B 69/34* (2006.01)
*A63B 69/00* (2006.01)

(52) U.S. Cl. ..... 473/444; 473/441; 473/422

(58) Field of Classification Search ..... 473/438, 473/441–445; 482/83, 85–87
See application file for complete search history.

(56) References Cited

U.S. PATENT DOCUMENTS

| | | | | | |
|---|---|---|---|---|---|
| 2,526,217 | A | | 10/1950 | Gilman | |
| 2,574,046 | A | | 11/1951 | Logan | |
| D168,302 | S | * | 12/1952 | Holt | D29/100 |
| 2,994,534 | A | | 8/1961 | Davis et al. | |
| 3,111,317 | A | * | 11/1963 | Cituk | 473/444 |
| 3,329,428 | A | | 7/1967 | Moran | |
| 3,396,969 | A | * | 8/1968 | Rosenfeld | 473/444 |
| 3,514,105 | A | | 5/1970 | Pillard | |
| 3,558,135 | A | * | 1/1971 | Rees et al. | 473/444 |
| 3,680,861 | A | * | 8/1972 | Schmidt | 473/444 |
| 4,667,954 | A | * | 5/1987 | McCorkle | 482/86 |
| 4,802,670 | A | | 2/1989 | Smith | |
| 5,280,905 | A | * | 1/1994 | Micco | 473/444 |
| 5,501,649 | A | * | 3/1996 | Queppet | 482/88 |
| 5,984,809 | A | * | 11/1999 | Hadar et al. | 473/444 |
| 6,261,194 | B1 | * | 7/2001 | Hadar et al. | 473/441 |

* cited by examiner

*Primary Examiner*—Mitra Aryanpour
(74) *Attorney, Agent, or Firm*—Kenneth A. Roddy

(57) ABSTRACT

A hand-held offensive lineman training pad formed of a resilient inner pad and a close fitting outer cover has a generally T-shaped tapered configuration with flat front and back sides and a generally rectangular cross section. The generally T-shaped pad has a relatively wide upper portion and an elongate lower portion having opposed lateral sides that taper downward and angularly inward and terminate at a flat bottom end to simulate the framework of the upper torso of a defensive lineman with the wider upper portion simulating the shoulder pads of the defensive lineman. A pair of shallow generally rectangular recessed pockets on each of the elongate lateral sides of the pad receive the fingertips of the offensive lineman and approximate the proper hand placement for an offensive lineman to engage a defensive lineman. The pad is effective in training an offensive lineman in proper hand placement and executing various blocking maneuvers.

5 Claims, 2 Drawing Sheets

HAND-HELD OFFENSIVE LINEMAN TRAINING PAD

CROSS REFERENCE TO RELATED APPLICATION

This application claims priority of U.S. Provisional Application Ser. No. 60/451,740, filed Mar. 4, 2003.

BACKGROUND OF THE INVENTION

1. Field of the Invention

This invention relates generally to football training dummies and pads, and more particularly to a hand-held football training pad for teaching offensive linemen proper hand and arm positioning and blocking techniques.

2. Brief Description of the Prior Art

In the game of football, as played in the United States, the ball is advanced downfield by a team playing offense, which is accomplished by either by running or the offensive passing. In both cases, the offensive lineman is charged with protecting the ball carrier or the passer. In a running play, the duties of an offensive lineman are to charge forward to trap, block or tackle a designated defensive player. In a passing situation, the duty of the offensive lineman is to hold at bay a charging defensive lineman for a sufficient length of time to enable the passer to locate and throw the football to his designated receiver. Typically, the offensive lineman, in a passing situation, adopts a braced stance and keeping the head between the defender and the direction of the play, comes off the line of scrimmage in a low trajectory at full speed, and makes explosive contact with a defender, known as the "punch". At the final step before contact with the defender, the offensive lineman constricts his closed hands and elbows tight into the torso and uncoils into the defender extending open hands to the point of locking the elbows. The arms and hands must remain inside the framework of the defensive lineman, typically inside the opponent's shoulders preferably to each outer side of the defenders jersey numbers, thumbs in or down.

Often, the offensive lineman will come off the line of scrimmage and miss the defensive player with either his right or left hand on the punch. After contact, the offensive lineman may slowly retreat, using either body blocks or his hands to hold back the charging defensive lineman, in order to give the passer time to locate and throw the football to the intended receiver. This is called pass blocking.

A number of training or blocking machines have been developed over the years to assist teaching defensive lineman how to effectively charge the offensive lineman. Most of these machines comprise a tackling dummy mounted on a skid or sled or anchored to the ground. There are several of patents that disclose sled or skid mounted tackling devices for teaching offensive lineman proper blocking techniques.

Moran, U.S. Pat. No. 3,329,428 discloses a skid-mounted cylindrical impact bag which simulates a single charge of a defensive lineman.

Pillard, U.S. Pat. No. 3,514,105 discloses a sled-mounted generally rectangular contoured dummy that simulates a side stepping defensive lineman.

Smith, U.S. Pat. No. 4,802,670 discloses a sled-mounted generally rectangular blocking pad for simulating a torso of an on-rushing defensive lineman attached to the extending end of a telescoping ram assembly and a thrust bar attached to the telescoping ram assembly for imparting thrust forces to selectively extend or retract the telescoping ram assembly to simulate the rush of a defensive lineman. The pad can be rotated 90 degrees to simulate a torso of a football player attempting a cut block.

There are also several of patents that disclose portable hand-held blocking pads or dummies for training football players in various blocking techniques.

Gilman, U.S. Pat. No. 2,526,217 discloses a hand-held shield-like blocking pad having a pair of handles stitched to the rear of the pad which is carried by defensive players during football scrimmage to protect the players against injury.

Logan, U.S. Pat. No. 2,574,046 discloses an inflatable hand-held dummy having a generally oval configuration with a concave surface on one side.

Davis et al, U.S. Pat. No. 2,994,534 discloses an inflatable hand-held dummy having a generally oval configuration with a wider upper portion for simulating a torso of an opposing player and a central opening for receiving the helmet in practicing head blocking maneuvers.

Rosenfeld, U.S. Pat. No. 3,396,969 discloses a hand-held dummy having a generally rectangular configuration with a square cross section with pairs of hand grips on adjacent sides near opposite ends whereby the dummy may be used with either end uppermost to divide wear in use between two of the sides.

None of these devices adequately train the offensive lineman in the proper hand placement for an offensive lineman to engage a defensive lineman, and give the realistic feel of a correct offensive grip and blocking maneuvers and simulate the repeated and extended charges of a defensive lineman to train the offensive lineman in techniques for simultaneously retreating and reblocking a charging defensive lineman.

The present invention is distinguished over the prior art in general, and these patents in particular, by a hand-held offensive lineman training pad formed of a resilient inner pad and a close fitting outer cover that has a generally T-shaped tapered configuration with flat front and back sides and a generally rectangular cross section. The generally T-shaped pad has a relatively wide upper portion and an elongate lower portion having opposed lateral sides that taper downward and angularly inward and terminate at a flat bottom end to simulate the framework of the upper torso of a defensive lineman with the wider upper portion simulating the shoulder pads of the defensive lineman. A pair of shallow generally rectangular recessed pockets on each of the elongate lateral sides of the pad receive the fingertips of the offensive lineman and approximate the proper hand placement for an offensive lineman to engage a defensive lineman. The pad is effective in training an offensive lineman in proper hand placement and executing various blocking maneuvers.

SUMMARY OF THE INVENTION

It is therefore an object of the present invention to provide a hand-held training pad for training offensive lineman that simulates the torso of a defensive lineman and can be maneuvered to simulate the realistic movements of an onrushing defensive lineman and the repeated charges made by said lineman during a passing play.

It is another object of this invention to provide a hand-held training pad for training offensive lineman that has a pair of shallow recessed pockets on each of located on lateral sides of the pad to receive the fingertips of the offensive lineman and approximate the proper hand placement for an offensive lineman to engage a defensive lineman.

Another object of this invention is to provide a hand-held training pad for training offensive lineman that may be securely gripped by a coach or trainer and easily and quickly maneuvered and to simulate the realistic force and movements of a defensive lineman.

Another object of this invention is to provide a hand-held training pad for training offensive lineman to properly position and maintain their arms and hands inside the framework of a defensive lineman, and reduce the problem of missing the defensive player with either his right or left hand on the punch.

A further object of this invention is to provide a hand-held training pad for training an offensive lineman to hold a charging defensive lineman at bay and slowly retreat using either body blocks or his hands to hold back the charging defensive lineman while a pass play takes place.

A still further object of this invention is to provide a hand-held training pad for training offensive lineman that is simple in construction and inexpensive to manufacture.

Other objects of the invention will become apparent from time to time throughout the specification and claims as hereinafter related.

The above noted objects and other objects of the invention are accomplished by a hand-held offensive lineman training pad formed of a resilient inner pad and a close fitting outer cover that has a generally T-shaped tapered configuration with flat front and back sides and a generally rectangular cross section. The generally T-shaped pad has a relatively wide upper portion and an elongate lower portion having opposed lateral sides that taper downward and angularly inward and terminate at a flat bottom end to simulate the framework of the upper torso of a defensive lineman with the wider upper portion simulating the shoulder pads of the defensive lineman. A pair of shallow generally rectangular recessed pockets on each of the elongate lateral sides of the pad receive the fingertips of the offensive lineman and approximate the proper hand placement for an offensive lineman to engage a defensive lineman. The pad is effective in training an offensive lineman in proper hand placement and executing various blocking maneuvers.

DESCRIPTION OF THE PREFERRED EMBODIMENT

Figure 1:
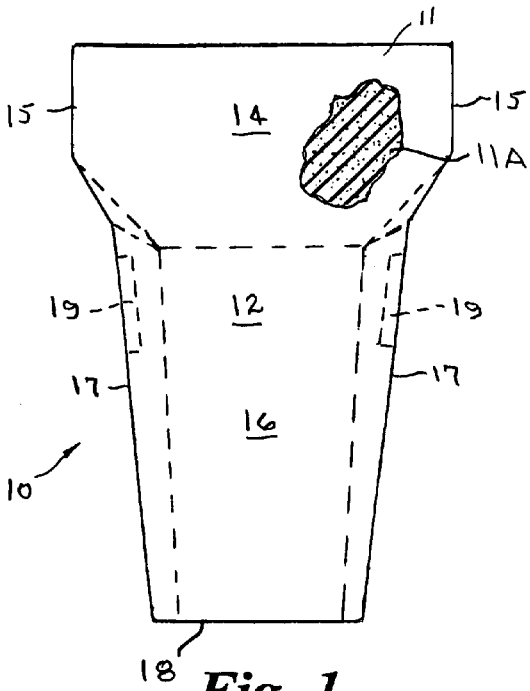
FIG. 1 is a front elevation view of the hand-held offensive lineman training pad in accordance with the present invention.

Referring to the drawings by numerals of reference, there is shown in FIGS. 1 through 5, a hand-held offensive lineman training pad 10 in accordance with a preferred embodiment of the present invention. The training pad 10 has a generally T-shaped configuration and a generally rectangular cross section, and is formed of a resilient generally T-shaped inner pad 11A and a close fitting outer cover 11. In FIGS. 1 and 6, the inner pad 11A is shown within the irregular shaped areas representing removed portions of the outer cover 11. In a preferred embodiment, the resilient inner pad 11A is formed of urethane foam and the outer cover 11 is formed of eighteen-ounce vinyl, however, it should be understood that other suitable resilient materials may be used for the inner pad and other suitable materials may be used for the outer cover.

Figure 2:
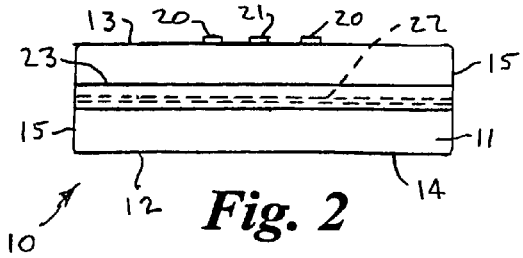
FIG. 2 is a top plan view of the pad.
Figure 4:
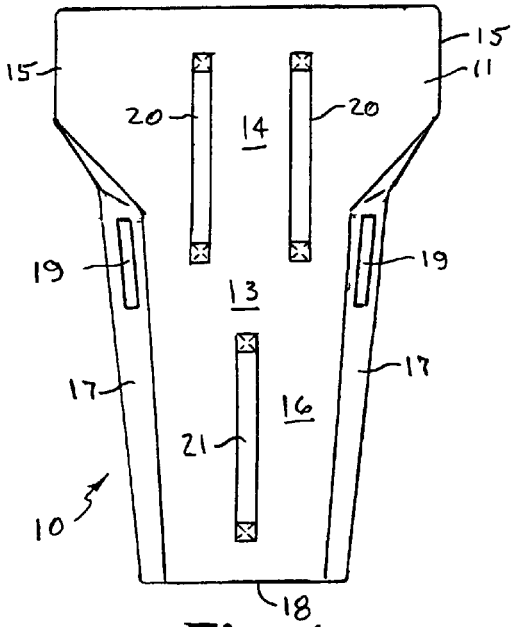
FIG. 4 is a rear elevation view of the pad.

The pad 10 has a flat front side 12 (FIG. 1) and a flat back side 13 (FIG. 4). As best seen in FIGS. 1, 2 and 4, the generally T-shaped configuration of the pad 10 includes a relatively wide upper portion 14 having laterally opposed straight sides 15 that extend vertically downward a short distance and then converge downward and angularly inward a distance and adjoin an elongate lower portion 16 having opposed lateral sides 17 which converge downward and angularly inward and terminate at a flat bottom end 18.

Figure 3:
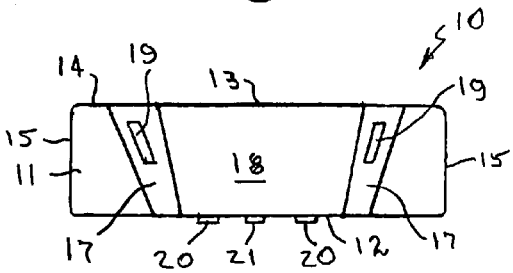
FIG. 3 is a bottom plan view of the pad.
Figure 5:
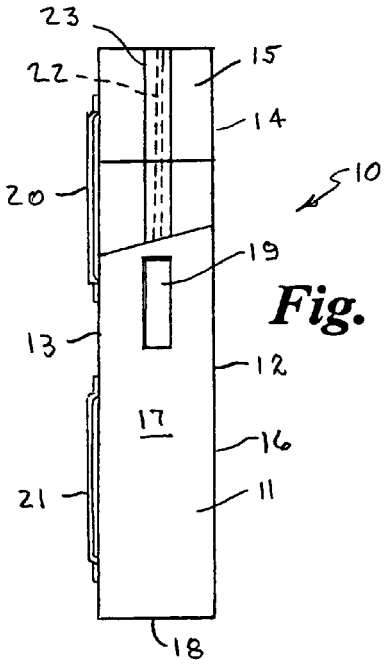
FIG. 5 is a side elevation view of the pad.
Figure 6:
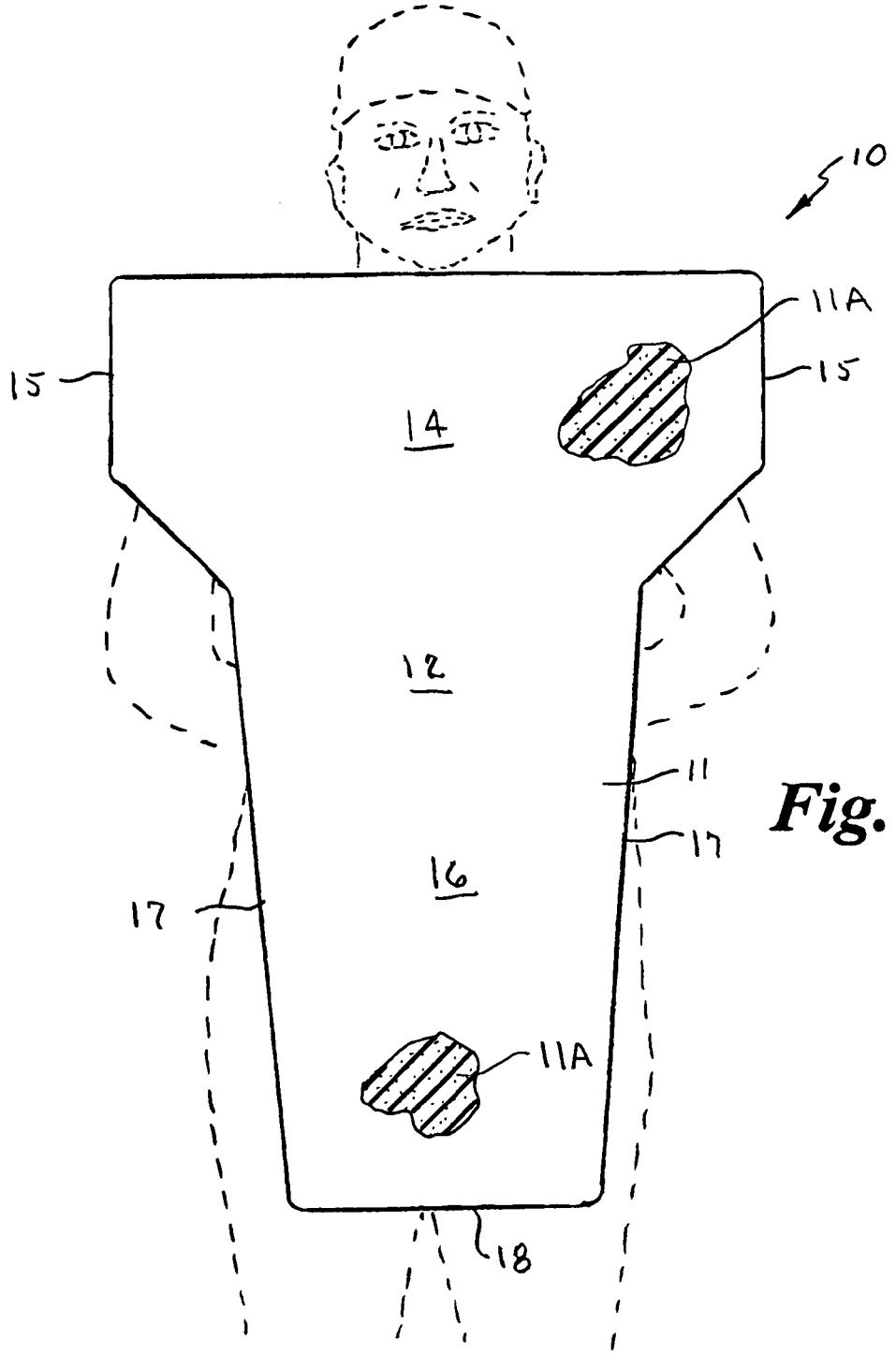
FIG. 6 is a front elevation view of the pad, being held by a trainer.

As best seen in FIGS. 3, 4 and 5, the elongate lower portion 16 of the back side 13 has the same profile as the lower portion of the front side 12, but is smaller in width beneath the laterally opposed straight sides 15 of the upper portion 14. Thus, opposed elongate lateral sides 17 of the lower portion 16 extend angularly rearward from the front side 12 to the back side 13, and the bottom end 18 is generally wedge shaped.

In a preferred embodiment, the relatively wide upper portion 14 is approximately 20" in width between the laterally opposed straight sides 15 and the laterally opposed straight sides 15 extend vertically downward approximately 6" and converge downward and angularly inward to a width of approximately 13/1;2" on the front side 12 and to a width of approximately 10½" on the back side 13, and the elongate lower portion 16 tapers downward to a width of approximately 11½" on the front side and to a width of approximately 8½" on the back side. The overall length of the pad 10 is approximately 31". Thus, the pad 10 is configured to simulate the framework of the upper torso of an on-rushing defensive lineman with the wider upper portion 14 simulating the shoulder pads of the defensive lineman.

A pair of generally rectangular recessed pockets 19 are located one on each of the opposed elongate lateral sides 17 of the lower portion 16 a short distance beneath where the downward and angularly inward bottom portions of the opposed straight sides 15 adjoin the elongate lower portion. The recessed pockets 19 extend inwardly a short distance into the pad 10 from the respective lateral sides 17 of the lower portion 16, and are sized to receive the fingertips of a player practicing with the pad. The lateral spacing and location of the pockets 19 are inside of the simulated defensive lineman's shoulders to each outer side of where the defensive lineman's jersey numbers would be.

As best seen in FIG. 4, an upper pair of generally rectangular handles or holding straps 20 are secured at their opposite ends to the upper portion 14 of the back side 13 in laterally spaced apart relation by stitching or other conventional means. A third generally rectangular lower handle or holding strap 21 is secured at its opposed ends to the lower portion 16 of the back side 13 in a position generally centered between and a distance beneath the upper pair of handles 20. The intermediate portions of the handles or holding straps 20 and 21 are loose or free from the outer cover to allow the pad 10 to be securely supported by a person holding the pad in various ways, as described hereinafter.

The exterior cover 11 has a zippered opening 22, indicated in dashed line, that extends across top of the wider upper portion 14 and along the laterally opposed straight sides 15 and their inwardly converging portions. The zippered opening 22 is covered by a rectangular flap 23 of the exterior cover material. The zipper is conventional in the art and therefore not shown in detail.

The resilient inner pad is precut or preformed to the shape described above, including the rectangular recessed pockets. The pad 10 is assembled by unzipping the opening 22 of the exterior cover 11 and inserting the resilient inner pad into the top end of the cover, zipping the cover closed, and then poking the material of the exterior cover forming the pockets 19 into the rectangular pocket recesses formed in the resilient inner pad.

The training pad 10 may be held in both hands by a coach or trainer gripping both of the upper handles or holding straps 20 and supporting it in front of his body, as seen in FIG. 6. The pad 10 may also be held by the coach or trainer inserting his forearm transversely through one of the upper handles or holding straps and gripping the other upper laterally spaced handle or strap with his hand and gripping the lower handle or strap 21 with his other hand. The training pad 10 may be maneuvered up or down or laterally to simulate the movements of a defensive lineman.

The training pad 10 is supported a distance in front of the offensive lineman and the offensive lineman assumes a braced stance and comes off the line in a low trajectory at full speed, and makes explosive contact with a training pad 10, known as the "punch". At the final step before contact with the pad, the offensive lineman constricts his closed hands and elbows tight into the torso and uncoils into the defender extending open hands to the point of locking the elbows.

In carrying out the maneuver, the offensive lineman positions his arms and open hands to grip the sides of the pad 10 and place the fingertips into the pockets 19, thus training the player to properly position his arms and hands inside the framework of the defensive lineman, that is to say, inside the defensive lineman's shoulders to each outer side of the defenders jersey numbers. This also aids in overcoming the problem of the offensive lineman missing the defensive player with either his right or left hand on the punch.

The training pad 10 also trains the offensive lineman to hold at bay a charging defensive lineman, after contact, for a sufficient length of time to enable a passer to locate and throw the football to his designated receiver, and to slowly retreat, using either body blocks or his hands to hold back the charging defensive lineman. During these maneuvers, the coach or trainer holding the pad 10 may shift his body from side to side and move forward or rearward to simulate the movements of an actual defensive lineman. The coach or trainer holding the pad 10 may also make repeated forceful upward and/or thrusting movements, thereby simulating the repeated and extended charges of an actual defensive lineman, and training the offensive lineman to make simultaneously retreating and reblocking movements against a charging defensive lineman.

While this invention has been described fully and completely with special emphasis upon a preferred embodiment, it should be understood that the invention may be practiced otherwise than as specifically described herein.

The invention claimed is:

1. A football training pad supported and maneuvered by a person to simulate movements of a defensive lineman for use in training an offensive lineman in the proper hand placement and execution of offensive lineman blocking maneuvers, comprising:

a resilient pad of generally rectangular cross section having a front side, a back side, and opposed lateral sides disposed between said front and back sides, and having a generally T-shaped outer periphery with a relatively wider upper portion, an elongate narrower lower portion, and said opposed lateral sides tapering downward and angularly inward terminating in a bottom end generally simulating the configuration of the upper torso of a defensive lineman and the wider upper portion generally simulating the shoulder pads of the defensive lineman;

holding straps on said back side positioned to receive at least one hand and/or forearm of a person for supporting and maneuvering said pad in front of the person holding said pad to simulate movements of a defensive lineman; and a pair of shallow generally rectangular recessed pockets disposed one on each of said lateral sides beneath said relatively wider upper portion for receiving the fingertips of an offensive lineman and positioned thereon to approximate a desirable proper hand placement position for an offensive lineman to engage a defensive lineman.

2. The training pad according to claim 1, wherein said pad is formed of an inner pad of resilient material and a close fitting outer cover.

3. The training pad according to claim 1, wherein said holding straps comprise an upper pair of generally rectangular holding straps on said back side disposed in laterally spaced apart relation, and a third generally rectangular lower holding strap on said back side disposed in a position generally centered between and a distance beneath said upper pair of holding straps; whereby said pad is supported and maneuvered up or down or laterally to simulate the movements of a defensive lineman by the person holding said pad selectively gripping each of said upper pair of laterally spaced holding straps with each hand, or by the person inserting a forearm transversely through one of said upper laterally spaced holding straps and gripping the other one of said upper laterally spaced holding straps with one hand and gripping said lower holding strap with the other hand.

4. The training pad according to claim 1, wherein said elongate lower portion on said back side is smaller in width than said elongate lower portion on said front side, and said elongate lower portion opposed lateral sides extend angularly rearward from said front side to said back side.

5. The training pad according to claim 1, wherein said pad is formed of an inner pad of resilient material and a close fitting outer cover;

said outer cover having a zippered opening that extends across a top end top of said wider upper portion and along said laterally opposed straight sides of said upper portion and their downward and angularly inwardly converging portions, and a rectangular flap covering said zippered opening.

* * * * *